United States Patent [19]

Pierrey

[11] Patent Number: 4,585,058

[45] Date of Patent: Apr. 29, 1986

[54] HEAT EXCHANGER HAVING A BUNDLE OF STRAIGHT TUBES

[75] Inventor: Jean-Louis Pierrey, Bourg la Reine, France

[73] Assignee: Novatome, Le Plessis Robinson, France

[21] Appl. No.: 541,746

[22] Filed: Oct. 13, 1983

[30] Foreign Application Priority Data

Nov. 5, 1982 [FR] France ..... 82 18571

[51] Int. Cl.[4] ..... F28F 13/00

[52] U.S. Cl. ..... 165/135; 165/96; 165/158; 165/83; 165/134.1; 122/32

[58] Field of Search ..... 165/134 R, 158, 135, 165/96, 83; 122/32

[56] References Cited

U.S. PATENT DOCUMENTS

| | | | |
|---|---|---|---|
| 3,000,728 | 9/1961 | Long et al. | 165/135 |
| 3,126,949 | 3/1964 | Boni, Jr. et al. | 165/158 |
| 3,187,807 | 6/1965 | Ammon | 165/158 |
| 3,490,521 | 1/1970 | Byerley | 165/158 |
| 3,520,356 | 7/1970 | Bell et al. | 165/135 |
| 3,776,302 | 2/1972 | Waszink et al. | 122/32 |
| 3,805,890 | 4/1974 | Boardman et al. | 122/32 |
| 3,868,994 | 3/1975 | Petrek | 165/135 |
| 3,907,026 | 9/1975 | Mangus | 165/135 |
| 3,908,756 | 9/1975 | Richardson | 165/158 |
| 4,088,182 | 5/1978 | Basdekas et al. | 165/96 |
| 4,285,393 | 8/1981 | Maus et al. | 165/134 R |
| 4,366,854 | 1/1983 | Artaud et al. | 122/32 |
| 4,377,552 | 3/1983 | Doublet et al. | 165/83 |

FOREIGN PATENT DOCUMENTS

| | | | |
|---|---|---|---|
| 0054357 | 4/1979 | Japan | 165/83 |

*Primary Examiner*—William R. Cline
*Assistant Examiner*—John K. Ford
*Attorney, Agent, or Firm*—Pollock, Vande Sande & Priddy

[57] ABSTRACT

Heat exchanger comprising a bundle (35) with straight vertical tubes, whose inner wall serves as the entry duct (46) for the fluid to be heated. This inner wall consists of a first shell (45) having a vertical axis, welded to the lower tube plate (39), a second shell (46) coaxial with the first and similarly fixed to the tube plate (39) and a third shell (47) fixed to the upper tube plate (40) and extended downwards between the two plates (39 and 40). The three shells are joined to the upper part of the exchanger so as to form two chambers (54 and 55) filled with inert gas. The inner shell (45) is joined to an entry duct (48) for the fluid to be heated. The invention applies, in particular, to intermediate heat exchangers of fast neutron nuclear reactors of an integrated type.

3 Claims, 2 Drawing Figures

HEAT EXCHANGER HAVING A BUNDLE OF STRAIGHT TUBES

FIELD OF THE INVENTION

The invention relates to a heat exchanger with two fluids one of which enters and leaves the exchanger through its upper part.

BACKGROUND OF THE INVENTION

Exchangers of this type are employed, for example, in fast neutron nuclear reactors of the integrated type where the heat evolved by the reactor core is removed by virtue of the primary sodium which is contained in the reactor vessel and in which the reactor core is submerged. The heat is transmitted to the steam generator through the intermediary of secondary sodium which is heated by the primary sodium in heat exchangers immersed in the primary sodium filling the vessel, called intermediate heat exchangers. Secondary sodium enters these intermediate exchangers through their upper part, above the slab closing the reactor vessel, and also has to leave the intermediate heat exchanger through this upper part.

Such heat exchangers comprise a tube bundle having an annular shape and straight vertical tubes in which the secondary sodium is made to circulate upwards. The tube bundle comprises annular tube plates in its lower part and in its upper part, respectively. The secondary sodium is led under the lower tube plate, for circulation through the tubes of the bundle, by a central vertical duct passing through the entire height of the exchanger and joined in its upper part to a supply duct for secondary sodium. At the exit from the bundle, the secondary sodium enters an annular duct arranged coaxially relative to the secondary sodium entry duct and likewise opening into the upper part of the exchanger. The tube bundle is immersed in the primary sodium, which is circulated in contact with the outer surface of the bundle tubes by means of circulating pumps immersed in the primary sodium contained in the reactor vessel.

The secondary sodium entry duct under the lower plate of the tube bundle consists of a cylindrical double wall with a vertical axis also forming the inner wall of the tube bundle. This cylindrical double wall consists of a first shell welded to the two tube plates of the bundle, along their inner edges and extended upwards as far as the upper level of the exchanger, and of a second cylindrical shell coaxial with the first, fixed to the lower plate of the tube bundle along its inner edge and joined at its upper part to the secondary sodium entry duct. This second shell is arranged inside the first, the two shells being joined at their upper part by a leak-tight expansion joint making it possible to establish a gas atmosphere for thermal insulation (for example of argon) in the annular space between the two shells forming the inner wall of the tube bundle and the secondary sodium entry duct. This gas layer also allows the secondary sodium entering the heat exchanger to be insulated thermally from the hot secondary sodium leaving the tube bundle.

In large-scale heat exchangers and in particular in the intermediate exchangers in fast neutron nuclear reactors which operate at elevated temperatures, there are high temperature gradients which are represented by stresses of a high amplitude in the components forming these exchangers.

In particular, the outer shell of the secondary sodium entry duct, which is welded both to the lower tube plate and to the upper tube plate of the bundle, is stressed very severely. The whole unit formed by this shell, the tubes of the bundle and the tube plates is, effectively, a single unit and hyperstatic. In this assembly, the various components, for example the shell and the bundle tubes, have very different stiffnesses.

The heat exchanger is therefore subject to high differential expansions and deformations in its central part comprising the inner wall of the tube bundle.

SUMMARY OF THE INVENTION

The aim of the invention is therefore to propose a heat exchanger for high temperature fluids one of which, the first fluid, enters the exchanger in its upper part, circulates upwards inside the exchanger in the straight vertical tubes of a bundle having an annular shape with a vertical axis, comprising an annular lower tube plate and an annular upper tube plate as well as a central cylindrical inner wall coaxial with the bundle, serving as entry duct for the first fluid under the lower tube plate and, finally, leaves the exchanger in its upper part, through an annular exit duct coaxial with the entry duct for the fluid and thermally insulated from the latter, the second fluid circulating in contact with the outer surface of the tubes of the bundle, this heat exchanger not being subject to excessive stresses of a thermal or mechanical origin in its central part comprising the inner wall of the tube bundle.

For this purpose, the inner wall serving as the entry duct for the first fluid consists of:

a first cylindrical shell with a vertical axis welded in its lower part to the lower tube plate of the exchanger along its inner edge and joined in its upper part to an entry duct for the first fluid, a second shell coaxial with the first, fixed to the lower tube plate, arranged outside the first shell and extended upwards clearly above the upper tube plate, a third shell coaxial with the first two, fixed to the upper tube plate along its inner wall, arranged outside the second shell, extended downwards as far as a level situated between the two tube plates and upwards essentially to the level of the upper part of the second shell, the third shell being joined to the upper part of the other two, along its upper edge, so that a leakproof annular chamber is formed by the first two shells and filled with gas and that an annular chamber opening with its lower part into the second fluid circulating in contact with the bundle is bounded by the second and the third shells, this last annular chamber being connected to a source of inert gas.

BRIEF DESCRIPTION OF THE DRAWINGS

In order that the invention may be more clearly understood, a description will now be given, by way of example, with reference to the attached figures, of an intermediate heat exchanger of a fast neutron nuclear reactor of an integrated type, according to the prior art and an intermediate heat exchanger according to the invention.

DETAILED DESCRIPTION

Figure 1:
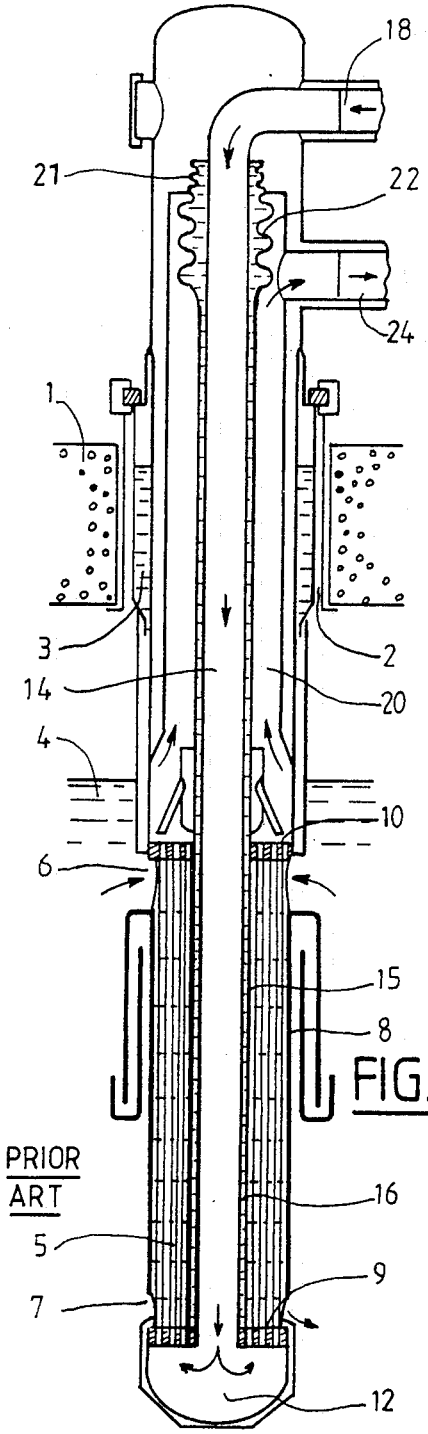
FIG.1 PRIOR ART
FIG. 1 shows, in a view in cross-section in a vertical plane, an intermediate heat exchanger according to the prior art.

FIG. 1 shows a heat exchanger passing through the slab 1 closing the vessel of a fast neutron nuclear reactor through a passage 2 comprising an assembly 3 allowing radiological protection and restricting the circulation of convection currents between the exchanger and the opening 2.

The lower part of exchanger comprising a tube bundle 5 is immersed under the upper level 4 of the liquid sodium filling the vessel and forming the primary fluid of the reactor. This primary fluid is circulated by pumps immersed in the vessel so that, on leaving the core, it enters the heat exchanger through the entry port 6. The primary sodium circulates in contact with the bundle tubes 5, to leave through the exit port 7 of the heat exchanger. Between the ports 6 and 7, the tube bundle is surrounded by a cylindrical shell 8.

The tube bundle comprises two tube plates, a lower tube plate 9 and an upper tube plate 10.

An entry chamber for the secondary sodium 12, into which opens the entry duct for this sodium 14, is arranged under the lower plate 9.

The duct 14 consists of a double wall formed by two vertical coaxial shells 15 and 16.

The outer shell 15 of this wall is fixed by welding to the lower plate 9 and to the upper plate 10 of the tube bundle.

The inner shell 16 in which the secondary sodium arriving at the heat exchanger is circulated, is welded in its lower part only to the lower plate 9. In its upper part, this shell 16 is welded to a secondary sodium entry duct 18 insulated thermally from the external environment and connected to the shell of the heat exchanger.

On leaving the tube bundle 5, the secondary sodium heated by the primary sodium enters an annular exit duct 20 coaxial with the shells 15 and 16. The outer shell of the duct 20 is joined in its upper part to the shells 15 and 16 through the intermediary of expansion joints 21 and 22.

An annular chamber is bounded by the shells 15 and 16, and this annular chamber is filled with an inert gas ensuring thermal insulation between the cold secondary sodium arriving through the duct 14 and the hot secondary sodium leaving by the annular duct 20.

In its upper part, the duct 20 is connected to a pipework 24 which conveys the hot sodium to the steam generator.

It is seen that the whole unit formed by the plates 9 and 10, the tubular exchanger 5 and the latter's inner shell 15 is extremely stiff, the straight tubes of the bundle as well as the shell 15 being welded to the tube plates 9 and 10. This great stiffness is due in particular to the fact that the tubes of the bundle are straight and numerous.

As a result, when the exchanger is immersed in the hot circulating sodium, there are large thermal and mechanical stresses in the shell 15 and differential expansions between the shells of the collector 20 which necessitate the use of many devices to make them acceptable.

Figure 2:
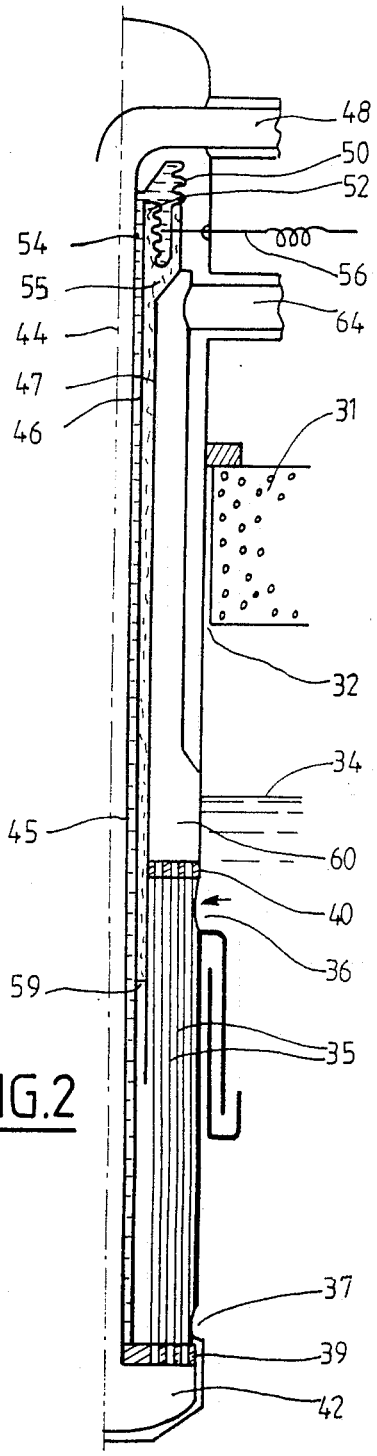
FIG. 2 shows, in a half-view in cross-section through a vertical plane of symmetry, a heat exchanger according to the invention.

FIG. 2 shows a heat exchanger passing through the slab 31 which closes the vessel of a fast neutron nuclear reactor containing liquid sodium up to a level 34, through a passage 32, some clearance existing between the outer surface of the heat exchanger and the passage 32.

As in the case of the intermediate exchanger according to the prior art, devices for radiological protection and for limiting convection currents are arranged in the passage 32, but are not shown.

The lower part of the heat exchanger immersed in the primary liquid sodium comprises a tube bundle 35, the primary liquid sodium circulating between the entry port 36 and the exit port 37 of the heat exchanger in contact with the outer surface of the tubes of the bundle 35.

The vertically arranged tubes of this bundle are straight and fixed at their lower end in a tube plate 39 and at their upper end in a tube plate 40.

Under the tube plate 39 is arranged a chamber 42 where the cold secondary sodium enters and serving to distribute it into the tubes of the bundle 35.

The cold secondary sodium is delivered into the chamber 42 by a central vertical duct 44 which bounds the inner part of the tube bundle 35 and by its extension.

This wall consists of three vertical and coaxial cylindrical shells.

The first, innermost, shell 45 is welded by its lower edge along the inner edge of the lower annular tube plate 39. The upper part of the shell 45 is joined to an entry duct 48 for the secondary sodium, which forms the first fluid, in the heat exchanger.

The second shell 46 arranged outside the shell 45 is welded by its lower edge to the lower tube plate 39 and its upper part is at the level of the upper part of the heat exchanger. The shells 45 and 46 are rigidly connected only to the lower tube plate 39.

The third shell 47 is welded to the upper tube plate 40, along the inner edge of this tube plate. This shell 47 is extended downwards as far as a level between the two tube plates 39 and 40, near the middle part of the tube bundle 35. The upper part of the third shell 47 is in the region of the upper part of the heat exchanger.

The shell 47 is joined through a gas-tight expansion joint 50 to the upper part of the shell 45. This shell 47 is also joined through a gas-tight expansion joint 52 to the upper part of the second shell 46.

On leaving the tube bundle 35, the secondary sodium forming the first fluid circulating in the heat exchanger enters an annular duct 60 coaxial with the shells 45, 46 and 47 and joined in its upper part to a duct 64 leading to the steam generator.

The secondary sodium heated by the primary sodium forming the second fluid of the exchanger is insulated in the duct 60 from the cold secondary sodium arriving through the central part of the exchanger at the chamber 42, by a double gas layer.

In fact, the gas-tight annular chamber 54 comprised between the shells 45 and 46 and the annular chamber 55 comprised between the shells 46 and 47 are filled with inert gas over the entire length of the duct 60.

The inert gas filling the chamber 54 is introduced in this chamber where it remains trapped after closure of the flexible joint 50. The chamber 55 is joined at its upper part to a circuit 56 for supplying inert gas at a controlled pressure.

The lower part of the annular chamber 54 opens out into the primary sodium forming the second fluid of the heat exchanger, circulating in contact with the outer surface of the tubes 35 of the bundle. The pressure of the inert gas (for example argon) conveyed into the chamber 54 by the controlled circuit 56 makes it possible to maintain the separation level 59 between the inert gas and the primary sodium under the tube plate 40.

It is seen that the principal advantage of the device according to the invention is that it comprises a wall inside the tube bundle which also forms the duct for the entry of the secondary sodium into the exchanger and is made up of three shells none of which is welded to both tube plates of the bundle at the same time and which together form thermal insulation chambers filled with inert gas. These shells are subjected only to low stresses when the intermediate exchanger is used, which increases the safety of operation of the heat exchanger and allows its design to be simplified.

The three shells forming the inner wall of the bundle can expand indpendently of each other, since their upper parts are joined by expansion joints, such as bellows.

The shells can be joined at their upper part, so as to allow differential expansions, in a different manner and by using expansion devices of a type other than bellows. The diameter of the various shells can moreover be non-uniform over their entire height.

The third shell can be extended downwards to any height between the two tube plates of the bundle. The chamber comprised between the second and third shells can be joined to any inert gas circuit permitting a control of the pressure of this inert gas as a function of the pressure of the primary sodium in the tube bundle.

Finally, the invention applies to any type of intermediate heat exchangers of a fast neutron nuclear reactor cooled by any fluid.

The invention applies to intermediate exchangers of an integrated reactor or to exchangers for fast neutron reactors of the loop type, which are, in this case, placed in tanks outside the vessel.

More generally, the invention applies to any large-scale heat exchanger in which the first fluid enters and leaves the exchanger through its upper part.

What is claimed is:

1. In a heat exchanger for high temperature fluids comprising a bundle of straight vertical tubes consisting of an annular lower tube plate (39), an annular upper tube plate (40), a plurality of tubes fixed between said plates and a central cylindrical inner wall coaxial with said plates serving as an entry duct (44) under said lower tube plate (39) for a first fluid which circulates upwards in the tubes of said bundle and leaves said exchanger in its upper part through an annular exit duct (60) coaxial with said entry duct (44), a second fluid circulating in contact with the outer surface of the tubes of said bundle (35), for exchanging heat with said first fluid, said inner wall serving as said entry duct (44) for said first fluid comprising (a) a first cylindrical shell (45) with a vertical axis welded in its lower part to said lower tube plate (39) along its inner edge and joined in its upper part to a supply duct for said first fluid (48);

(b) a second shell (46) coaxial with said first shell, fixed to said lower tube plate arranged outside said first shell (45) and extended upwards clearly above said upper tube plate (40);

(c) a third shell (47) coaxial with said first and second shells fixed to said upper tube plate (40) along its inner wall, arranged outside said second shell (46), extended downwards as far as a level situated between said lower and upper tube plates (39, 40) and upwards substantially to the level of an upper part of said second shell (46), said third shell (47) being joined to the upper part of said first and second shells (45, 46) along its upper edge, with means forming a leak-proof annular chamber (54) between said first and second shells (45, 46) which is filled with gas and that a chamber (55) opening with its lower part into said second fluid circulating in contact with said bundle (35) is bounded by said second and third shells (46, 47), said last mentioned annular chamber (55) being connected to a source of inert gas.

2. The combination claimed in claim 1, wherein said third shell (47) is joined to the upper part of said first and second shells (45, 46) via expansion joints with bellows (50, 52).

3. The combination claimed in claim 1 or 2, wherein said source of inert gas is a circuit of inert gas (56) whose pressure maintains the level (59) of said second fluid below said upper tube plate (40).

* * * * *